US005613255A

United States Patent [19]

Bish et al.

[11] Patent Number: 5,613,255

[45] Date of Patent: Mar. 25, 1997

[54] HOSPITAL BED HAVING SCISSORS LIFTING APPARATUS

[75] Inventors: Michael P. Bish, Harrison, Ohio; William M. Blyshak, Milan, Ind.; Donald E. Smith, Greensburg, Ind.; Jonathan D. Turner, Dillsboro, Ind.

[73] Assignee: Hill-Rom, Inc., Batesville, Ind.

[21] Appl. No.: 363,899

[22] Filed: Dec. 27, 1994

[51] Int. Cl.[6] ..... A61G 7/00

[52] U.S. Cl. ..... 5/611; 5/610

[58] Field of Search ..... 5/610, 611, 11, 5/8

[56] References Cited

U.S. PATENT DOCUMENTS

| | | | |
|---|---|---|---|
| 346,246 | 7/1886 | Uhde | 5/611 |
| 2,587,094 | 2/1952 | Berg | 5/611 |
| 3,217,340 | 11/1965 | Durr | 5/611 |
| 3,237,212 | 3/1966 | Hillenbrand et al. . | |
| 3,793,652 | 2/1974 | Linehan | 5/611 |
| 3,958,283 | 5/1976 | Adams et al. . | |
| 4,025,972 | 5/1977 | Adams et al. . | |
| 4,097,939 | 7/1978 | Peck et al. . | |
| 4,196,483 | 4/1980 | Lefler et al. . | |
| 4,451,945 | 6/1984 | Heinz | 5/611 |
| 4,669,136 | 6/1987 | Waters | 5/611 |
| 4,918,766 | 4/1990 | Leonaggeo | 5/611 |
| 4,985,946 | 1/1991 | Foster et al. . | |
| 5,074,000 | 12/1991 | Soltani et al. . | |
| 5,148,562 | 9/1992 | Borders et al. . | |
| 5,317,769 | 6/1994 | Weismiller et al. . | |

*Primary Examiner*—Flemming Saether
*Attorney, Agent, or Firm*—Barnes & Thornburg

[57] ABSTRACT

A hospital bed includes a base and a deck having a head end and a foot end. A first scissors lift linkage is coupled between the base and the deck adjacent the head end of the deck. The first scissors lift linkage is movable from an extended position to a retracted position to raise and lower, respectively, the head end of the deck relative to the base. A second scissors lift linkage is coupled between the base and the deck adjacent the foot end of the deck. The second scissors lift linkage is movable from an extended position to a retracted position to raise and lower, respectively, the foot end of the deck relative to the base. A controller is provided for selectively and independently moving the first and second scissors lift linkages between the extended positions and the retracted positions.

27 Claims, 3 Drawing Sheets

HOSPITAL BED HAVING SCISSORS LIFTING APPARATUS

BACKGROUND AND SUMMARY OF THE INVENTION

The present invention relates to a hospital bed. More particularly, the present invention relates to an improved mechanism for raising and lowering a hospital bed.

Hospital beds must typically have the ability to raise and descend in order to make it easier for patients to get into and out of the hospital bed. It is desirable for the bed to be able to be lowered as close to the ground as possible. In addition, it is desirable to provide adequate space beneath a patient support surface of the bed to permit medical equipment to move underneath the support surface during various medical procedures.

It is also important for the hospital bed to have the capability of shifting to a Trendelenburg position in which the patient support surface is inclined with a head end of the patient support surface lowered below a foot end. The Trendelenburg position is important for the patient's well being if the patient should undergo cardiac arrest.

The novel lifting apparatus of the present invention advantageously provides these important features while reducing the overall weight of the bed. In addition, the present invention minimizes surface deflection or "spring board effect" of the sleep surface of the bed. The present invention also advantageously provides complete access for fluoroscopic equipment such as C-Arm units from the patient's subclavian area through the patient's femoral area. The lifting apparatus of the present invention also provides a mechanical apparatus for achieving automatic Trendelenburg and reverse Trendelenburg positions.

According to one aspect of the present invention, a hospital bed includes a base and a deck for supporting a patient support surface. The bed also includes a scissors lift linkage coupled between the base and the deck. The scissors lift linkage is movable from an extended position to a retracted position to raise and lower, respectively, the deck relative to the base. The bed further includes a controller for selectively moving the scissors lift linkage between its extended position and its retracted position.

According to another aspect of the present invention, a hospital bed includes a base and a deck having a head end and a foot end. The bed also includes a first scissors lift linkage coupled between the base and the deck adjacent the head end of the deck. The first scissors lift linkage is movable from an extended position to a retracted position to raise and lower, respectively, the head end of the deck relative to the base. The bed further includes a second scissors lift linkage coupled between the base and the deck adjacent the foot end of the deck. The second scissors lift linkage is movable from an extended position to a retracted position to raise and lower, respectively, the foot end of the deck relative to the base. The bed still further includes a controller for selectively and independently moving the first and second scissors lift linkages between the extended positions and the retracted positions.

In the illustrated embodiment, the first scissors lift linkage is pivotably coupled to both the base and the deck, and the second scissors lift linkage is rigidly coupled to the base and pivotably coupled to the deck. The second scissors lift linkage is illustratively aligned in a plane which is generally perpendicular to a plane of the first scissors lift linkage to stabilize the deck relative to the base.

Also in the illustrated embodiment, the controller includes a first cylinder having a first piston coupled to the first scissors lift linkage. The first piston is movable from an extended position to a retracted position to move the first scissors lift linkage between its extended position and its retracted position, respectively. The controller also includes a second cylinder having a second piston coupled to the second scissors lift linkage. The second piston is movable from an extended position to a retracted position to move the second scissors lift linkage between its extended position and its retracted position, respectively. The first and second cylinders are illustratively pivotably coupled to the base, and the first and second pistons are pivotably coupled to the first and second scissors lift linkages, respectively.

Also in the illustrated embodiment, the first scissors lift linkage includes a pair of parallel first scissors mechanisms coupled together by top and bottom frame members. First sides of the first scissors mechanisms are pivotably coupled to the top and bottom frame members and second sides of the first scissors mechanisms are slidably coupled to the top and bottom frame members. The second scissors lift linkage includes a pair of parallel second scissors mechanisms coupled together by top and bottom frame members. First sides of both of the second scissors mechanisms are pivotably coupled to the top and bottom frame members, and second sides of the second scissors mechanisms are slidably coupled to the top and bottom frame members.

The controller illustratively includes means for moving the first scissors lift linkage to its retracted position and for moving the second scissors lift linkage to its extended position to align the deck in a Trendelenburg position. The controller also includes means for moving the first scissors lift linkage to its extended position and for moving the second scissors lift linkage to its retracted position to align the deck in a reverse Trendelenburg position.

As discussed above, the first and second scissors lift linkages are mounted generally perpendicular to each other. By mounting the scissors linkages generally perpendicular to each other, the present invention maximizes access under the deck for fluoroscopic equipment such as C-Arms, while minimizing the amount of unsupported length on the deck to reduce sleep surface deflection or spring board effect. Scissors lift linkages are stable in a plane perpendicular to the plane of the scissors lift linkage. Therefore, by providing first and second scissor lift linkages mounted perpendicular to each other, the lifting apparatus of the present invention provides stability for the hospital bed in all directions.

Advantageously, each scissors lift linkage is actuated by one single acting hydraulic or air cylinder. The piston of the cylinders have a stroke length of about 6 inches, while the scissors lift linkages each have a 20 ¼ inch stroke. Therefore, the mechanical advantage of the scissors lift linkages is over three times magnification of the input displacement of the piston of the cylinder. Therefore, the present invention facilitates moving the hospital bed to a low position by permitting use of smaller stroke cylinders. Due to the mechanical advantage of the scissors style lift linkage, the hospital bed of the present invention maximizes the range of movement of the deck from its low position to its elevated position.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
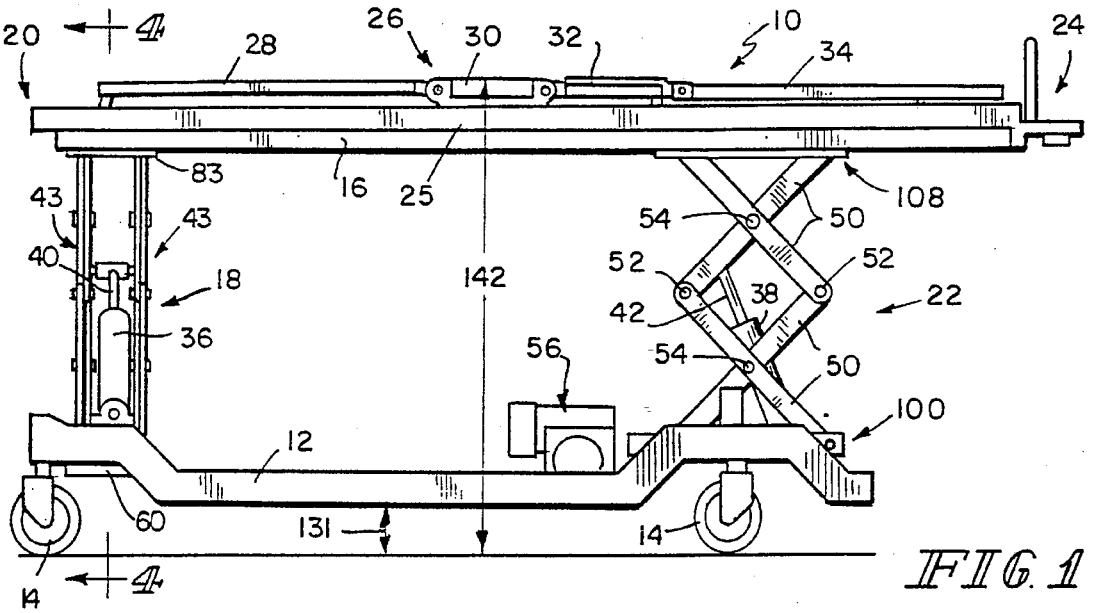
FIG. 1 is a side elevational view of a hospital bed of the present invention with head and foot scissors lift linkages in their extended positions to raise a deck and support surface of the bed to an elevated position.

Referring now to the drawings, FIG. 1 illustrates the hospital bed 10 of the present invention in an elevated position. Bed 10 includes a base 12 having a generally rectangular shape. Base 12 includes castors 14 to facilitate movement of bed 10. A deck 16 is supported above base 12 by a first, head scissors lift linkage 18 located near head 20 of bed 10 and a second, foot scissors lift linkage 22 located near foot end 24 of bed 10. A frame 25 having an articulable patient support surface 26 mounted thereon is coupled to deck 16. Articulable support surface 26 includes a head section 28, center sections 30 and 32, and foot section 34. Movement of the articulable support surface 26 is controlled by hydraulic cylinders (not shown) in a conventional manner.

Hydraulic cylinders 36 and 38 including pistons 40 and 42, respectively, are used to control movement of scissors lift linkages 18 and 22, respectively. Actuation of hydraulic cylinders 36 and 38 is controlled selectively and independently by a conventional controller 56 including a hydraulic pump and electronic circuitry to move the head and foot scissor lift linkages 18 and 22 from elevated or extended positions illustrated in FIG. 1 to retracted positions illustrated in FIG. 3 to raise and lower bed 10.

Although the preferred embodiment of the present invention includes hydraulic cylinders, it is understood that air cylinders may also be used. In addition, a suitable electrically controlled actuator may be used to move scissors lift linkages 18 and 22.

Figure 4:
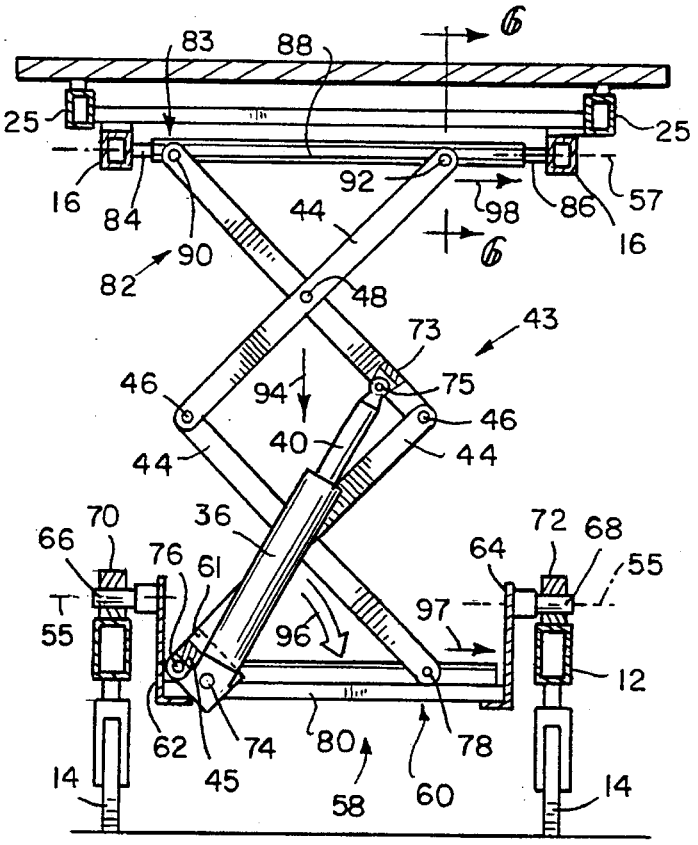
FIG. 4 is a sectional view taken along lines 4—4 of FIG. 1 illustrating details of the head scissors lift linkage of the present invention.
Figure 5:
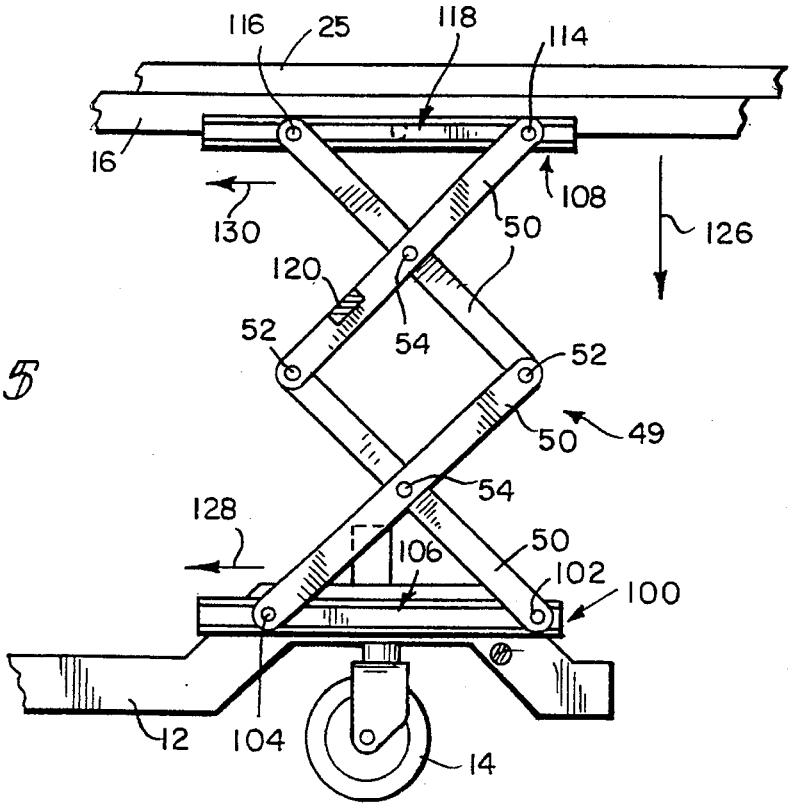
FIG. 5 is a sectional view taken along lines 5—5 of FIG. 2 illustrating details of the foot scissors lift linkage of the present invention.

Scissors lift linkage 18 includes a pair of spaced apart scissors mechanisms 43 including cross members 44 which are pivotably connected at the ends by pivot connections 46 and which are pivotably connected in a center portion of each frame member 44 by pivot connections 48 to provide a conventional scissors style lift mechanism 43. This is best illustrated in FIG. 4. Scissors linkage 22 includes a pair of spaced apart scissors mechanisms 49, including cross members 50 pivotably coupled together at ends by pivot connections 52 and pivotably coupled together in a center portion by pivot connections 54 as illustrated in FIGS. 1 and 5 to provide a conventional scissor style lift mechanism 49. Therefore, the term "scissors lift linkage" includes at least two frame members 44 or 50 interconnected by a pivot connector 48 or 54, respectively. Advantageously, the scissors lift linkages 18 and 22 provide increased movement of deck 16 while minimizing the necessary stroke length of pistons 40 and 42 in cylinders 36 and 38, respectively.

As illustrated in FIG. 4, a bottom end 58 of head scissors lift linkage 18 is pivotably coupled to base 12 by a bottom frame 60. Frame 60 includes end panels 62 and 64 having journal connections 66 and 68, respectively, mounted thereon. Journal connections 66 and 68 are rotatably coupled to base 12 by connections 70 and 72, respectfully. Therefore, bottom end 58 of head scissors lift linkage 18 pivots about an axis 55 which is transverse to a longitudinal axis of bed 10. It is understood that any type of bearing may be used in place of journal connections 66, 70 and 68, 72. Hydraulic cylinder 36 is pivotably coupled to a mounting bracket 61 by pivot connection 74. Mounting bracket 61 is rigidly coupled to frame member 45 of scissors mechanism 43. Therefore, cylinder 36 pivots about pivot connection 74 as frame members 44 pivot. Piston rod 40 is pivotably coupled to a cross bar 73 which interconnects the pair of scissor mechanisms 43 of head scissors lift linkage 18 by a pivot connection 75. A first side of each scissors mechanism 43 of scissors lift linkage 18 is pivotably coupled to frame 60 at location 76. A coupler pin 78 coupled to a second side of each scissors mechanism 43 of lift linkage 18 moves back and forth within a track 80 as discussed below during movement of scissors mechanism 43 from its elevated position illustrated in FIGS. 1 and 4 to its retracted position illustrated in FIG. 3.

Figure 6:
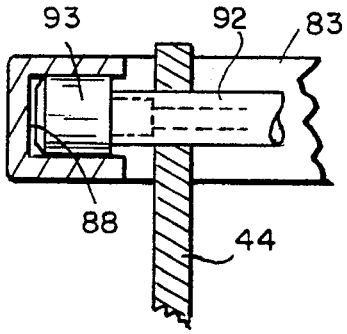
FIG. 6 is a sectional view taken along lines 6—6 of FIG. 4 illustrating a moving pin of the head scissors lift linkage located within a guide track of a top frame member.

A top end 82 of head scissors lift linkage 18 is also pivotably coupled to deck 16. A rectangular top frame member 83 interconnects the pair of scissors mechanisms 43 of head scissors lift linkage 18. Frame member 83 is pivotably coupled to deck 16 by journal connections 84 and 86. Therefore, top end 82 of head scissors lift linkage 18 pivots about an axis 57 which is transverse to the longitudinal axis of bed 10. It is understood that any type bearing may be used to couple top frame member 83 to deck 16 so that top end 82 of head scissors lift linkage 18 is pivotably coupled to deck 16. Frame member 83 includes a track 88. A first side of each scissors mechanism 43 of scissors lift linkage 18 is pivotably coupled to frame member 83 at location 90. A pin 92 is coupled to a second side of each scissors mechanism 43. A roller 93 is rotatably coupled to each pin 92 as illustrated in FIG. 6. Roller 93 rolls within track 88 as scissors linkage 18 moves between its extended position illustrated in FIGS. 1 and 4 and its retracted position illustrated in FIG. 3. Details of pin 92, roller 93, and track 88 are best illustrated in FIG. 6.

As piston 40 is moved within cylinder 36 from its extended position illustrated in FIG. 4 to a retracted position, scissors linkage 18 moves downwardly in the direction of arrow 94. Cylinder 36 pivots relative to frame 60 in the direction of arrow 96, and pins 78 and 92 move within tracks 80 and 88, respectively, in the directions of arrows 97 and 98, respectively.

Figure 2:
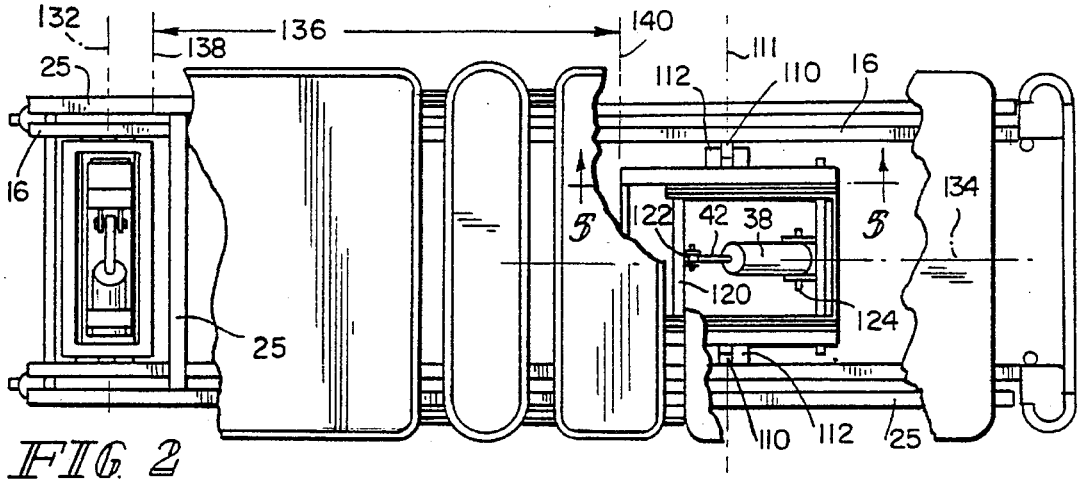
FIG. 2 is a top plan view of the hospital bed of FIG. 1 with portions broken away to illustrate details of the head and foot scissors lift linkages.

Additional details of the foot scissors lift linkage 22 are illustrated in FIG. 5. A bottom frame 100 interconnects the pair of foot scissors mechanisms 49 of scissors lift linkages 22. Frame 100 is rigidly coupled to base 12 and therefore does not pivot relative to base 12. This stabilizes the bed 10. A first side of each of the scissors mechanisms 49 of scissors lift linkage 22 is pivotably coupled to bottom frame 100 at location 102. A pin 104 coupled to a second side of each of the scissors mechanisms 49 of scissors lift linkage 22 moves back and forth within a track 106 of the bottom frame 100 as scissors linkage 22 moves from its extended position illustrated in FIGS. 1 and 5 to its retracted position illustrated in FIG. 3. A top frame 108 interconnects the pair of scissors mechanisms 49 of foot scissors lift linkage 22. Frame 108 is pivotably coupled to deck 16. As best illustrated in FIG. 2, deck 16 includes a pair of journals 110 coupled to frame member 108 by couplers 112 so that top frame 108 is pivotably coupled to deck 16. Therefore, foot scissors lift linkage 22 pivots relative to deck 16 about an axis 111 which is transverse to the longitudinal axis of the bed 10. A first side of each scissors mechanism 49 of scissors lift linkage 22 is pivotably coupled to top frame member 108 at location 114 illustrated in FIG. 5. A pin 116 coupled to a second side of each scissors mechanism 49 of scissors lift linkage 22 slides back and forth within track 118 of frame member 108 as scissors lift linkage 22 moves from its extended position to its retracted position. A cross bar 120 interconnects the pair of scissors mechanisms 49 of foot scissors lift linkage 22. Piston 42 is pivotably coupled to cross bar 120 by pivot connection 122 as best illustrated in FIG. 2. Cylinder 38 is pivotably coupled to frame 100 by pivot connection 124 as also illustrated in FIG. 2. When the controller 56 causes the cylinder 38 to move piston 42 from its extended position to its retracted position, scissors linkages 22 and deck 16 move downwardly in the direction of arrow 126 in FIG. 5. Pins 104 and 116 of scissors linkage 22 move inside tracks 106 and 118, respectively, in the directions of arrows 128 and 130. Cylinder 38 and piston 42 pivot in the same manner as cylinder 36 and piston 40 discussed above as the scissors lift linkage moves across from its extended position to its retracted position.

Cylinders 36 and 38 have a stroke length of about 6 inches. In other words, the pistons 40 and 42 moves about 6 inches from their extended positions to their retracted positions. Advantageously, by using scissors lift linkage 18 and 22, deck 16 moves about 20 ¼ inches from its extended position to its retracted position due to the mechanical advantage of the scissors lift linkages 18 and 22.

The pivoting arrangement of cylinders 36 and 38 relative to base 12 is advantageous because the cylinders 36 and 38 are not required to extend below frame 12 in order to actuate scissors lift linkages 18 and 22, respectively. Therefore, the lifting apparatus as a present invention maintains at least four inches of clearance between a bottom of base 12 and the ground as illustrated by dimension 131 in FIGS. 1 and 3 regardless of the position of deck 16 relative to base 12. This four inch clearance ensures that bed 10 will not bottom out when moving up an incline.

As best illustrated in FIG. 2, the pair of spaced apart scissors mechanisms 43 of head scissors lift linkage 18 lie in a plane substantially parallel to plane 132. The pair of spaced apart scissors mechanisms 49 of foot scissors lift linkage 22 lie in a plane parallel to plane 134. Scissors mechanisms are stable in a plane which is perpendicular to the plane of the scissors mechanism. Therefore, head scissors lift linkage 18 is more stable in plane 134 than in plane 132. Foot scissors lift linkage 22 is more stable in a plane parallel to plane 132 than in plane 134. FIG. 2 illustrates that head scissors lift linkage 18 is aligned in a plane 132 which is perpendicular to the plane 134 of foot scissors lift linkage 22. Therefore, the lifting apparatus of the present invention provides stability for bed 10 in all directions.

Figure 3:
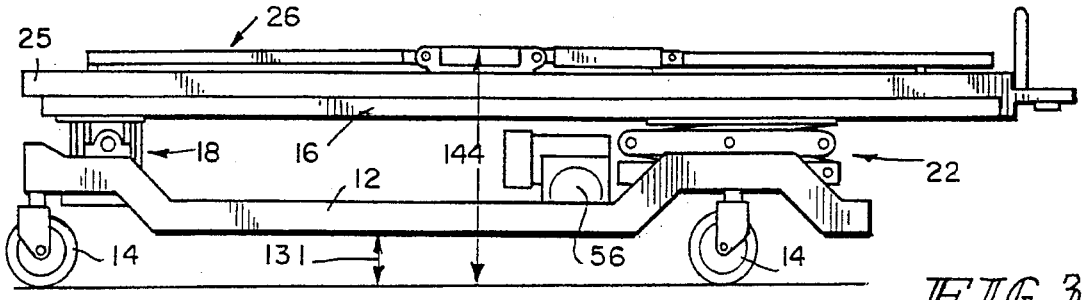
FIG. 3 is a side elevational view with the head and foot scissors linkages in their retracted positions to move the hospital bed to a low position to make it easier for a patient to get into and out of the bed.

The arrangement and positioning of head scissors lift linkage 18 and foot scissors lift linkage 22 also maximizes the available space beneath deck 16 for receiving medical equipment such as a C-Arm. This clearance area is illustrated by dimension 136 of FIG. 2. Advantageously, clearance area 136 extends between the head or neck (subclavian) region of the patient illustrated by location 138 to the femoral region of the patient illustrated by location 140. FIG. 1 illustrates the large open space under deck 16 for C-Arm clearance. Illustratively, the window 136 for C-Arm has a length of about 39 inches. The maximum height of support surface 26 illustrated by dimension 142 in FIG. 1 is about 38 ½ inches. The lower height of support surface 26 as illustrated by dimension 144 in FIG. 3 is about 18 inches. The mechanical advantage of the scissors lift linkages 18 and 22 permits the movement of the support surface 26 to a very low position illustrated in FIG. 3 to help a patient get into and out of the bed. In most instances, a patient's feet can touch the ground when bed 10 is in the lowered position illustrated in FIG. 3.

It is understood that in the commercial embodiment of the present invention, a bellows type shield (not shown) or other shield assembly will be located around the scissors lift linkages 18 and 22. These shields will provide protection to reduce the likelihood that patients or equipment will be caught between the moving scissors lift linkages 18 and 22.

Figure 7:
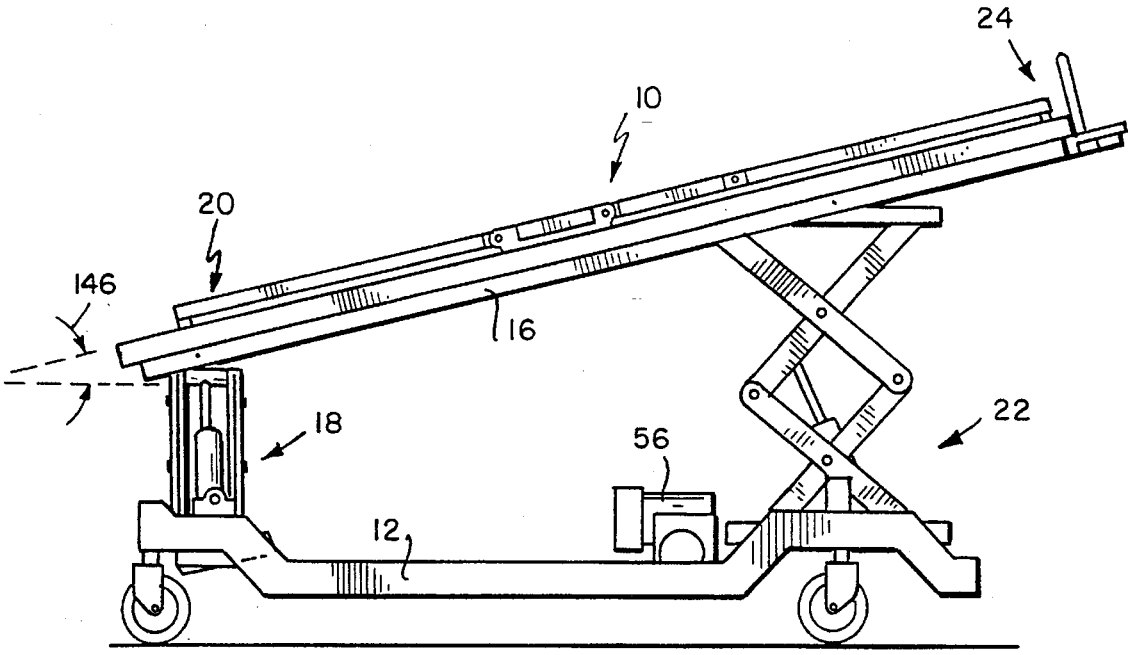
FIG. 7 is a side elevational view of the hospital bed in a Trendelenburg position.

Advantageously, the controller 56 may be controlled to lower the head scissors lift linkage 18 while the foot scissors lift linkage 22 remains in the extended position to position the bed 10 in a Trendelenburg position as best illustrated in FIG. 7. Since head scissors lift linkage 18 is pivotably coupled to both base 12 and deck 16, a large degree of movement can be obtained. In the Trendelenburg position, the foot 24 of bed 10 is elevated at an angle of about 12° above the head 20 as illustrated by angle 146 in FIG. 7.

Figure 8:
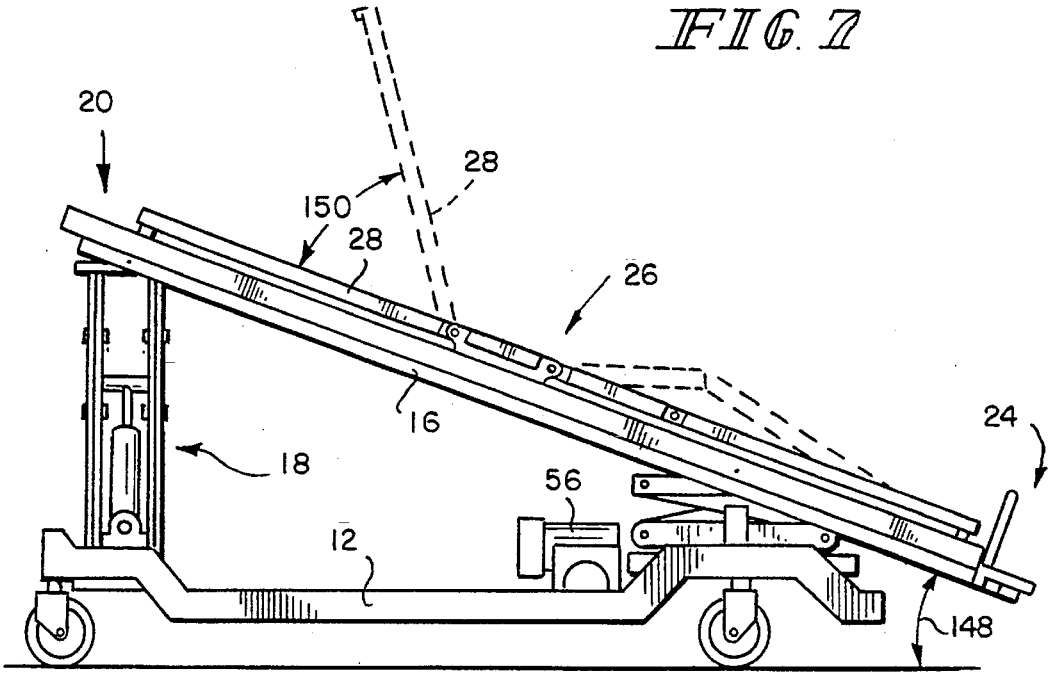
FIG. 8 is a side elevational view of the hospital bed in a reverse Trendelenburg position.

Also advantageously, controller 56 may control cylinders 36 and 38 to move head scissors lift linkage 18 to its fully extended position while foot scissors lift linkage 22 is moved to its retracted position. This elevates head 20 of bed 10 above foot 24 at an angle of about 22°–23° as illustrated by angle 148 of FIG. 8. This steep angle 148 is possible since both the top and bottom portions of head scissors lift linkage 18 pivot relative to base 12 and deck 16, respectively. The top portion of scissors lift linkage 22 also pivots relative to deck 16. This is a reverse Trendelenburg position. From this reverse Trendelenburg position illustrated in FIG. 8, the articulable support member 26 can be adjusted in a conventional manner to the dotted position illustrated FIG. 8 to provide a chair position for bed 10. Head support 28 can be angled at about 75 degrees relative to deck 16 as illustrated by angle 150 of FIG. 8.

Although the invention has been described in detail with reference to a certain preferred embodiment, variations and modifications exist within the scope and spirit of the present invention as described and defined in the following claims.

What is claimed is:

1. A hospital bed comprising:

a base;

a deck having a head end and a foot end;

a first scissors lift linkage coupled between the base and the deck adjacent the head end of the deck, the first scissors lift linkage being movable from an extended position to a retracted position to raise and lower, respectively, the head end of the deck relative to the base;

a second scissors lift linkage coupled between the base and the deck adjacent the foot end of the deck, the second scissors lift linkage being movable from an extended position to a retracted position to raise and lower, respectively, the foot end of the deck relative to the base, the second scissors lift linkage being aligned in a plane which is generally perpendicular to a plane of the first scissors lift linkage to stabilize the deck relative to the base; and a controller for selectively and independently moving the first and second scissors lift linkages between the extended positions and the retracted positions.

2. The apparatus of claim 1, wherein the first scissors lift linkage is pivotably coupled to both the base and the deck.

3. The apparatus of claim 2, wherein the second scissors lift linkage is rigidly coupled to the base and pivotably coupled to the deck.

4. The apparatus of claim 1, wherein the second scissors lift linkage is rigidly coupled to the base and pivotably coupled to the deck.

5. The apparatus of claim 1, wherein the controller includes a first cylinder having a first piston coupled to the first scissors lift linkage, the first piston being movable from an extended position to a retracted position to move the first scissors lift linkage between its extended position and its retracted position, respectively, and a second cylinder having a second piston coupled to the second scissors lift linkage, the second piston being movable from an extended position to a retracted position to move the second scissors lift linkage between its extended position and its retracted position.

6. The apparatus of claim 5, wherein the first and second cylinders and the first and second pistons are pivotably coupled to the first and second scissors lift linkages, respectively.

7. The apparatus of claim 1, wherein the first scissors lift linkage includes a pair of parallel first scissors mechanisms coupled together by top and bottom frame members, a first side of both of the first scissors mechanisms being pivotably coupled to the top and bottom frame members and a second side of the first scissors mechanisms being slidably coupled to the top and bottom frame members.

8. The apparatus of claim 7, wherein the second scissors lift linkage includes a pair of parallel second scissors mechanisms coupled together by top and bottom frame members, a first side of both of the second scissors mechanisms being pivotably coupled to the top and bottom frame members and a second side of the second scissors mechanisms being slidably coupled to the top and bottom frame members.

9. The apparatus of claim 8, further comprising a top pin and a bottom pin coupled to the second sides of each of the first and second scissors mechanisms, each of the top and bottom pins being movable in a corresponding track formed on the top and bottom frame members, respectively.

10. The apparatus of claim 8, wherein the controller includes a first cylinder pivotably coupled to the bottom frame member of the first scissors lift linkage, the first cylinder having a first movable piston which is pivotably coupled to the first scissors mechanisms; and a second cylinder pivotably coupled to the bottom frame member of the second scissors lift linkage, the second cylinder having a second movable piston which is pivotably coupled to the second scissors mechanisms.

11. The apparatus of claim 1, wherein the controller includes means for moving the first scissors lift linkage to its retracted position and for moving the second scissors lift linkage to its extended position to align the deck in a Trendelenburg position.

12. The apparatus of claim 1, wherein the controller includes means for moving the first scissors lift linkage to its extended position and for moving the second scissors lift linkage to its retracted position to align the deck in a reverse Trendelenburg position.

13. The apparatus of claim 1, further comprising an articulable patient support surface coupled to the deck.

14. A hospital bed comprising:

a base adapted to rest on a floor;

a deck for supporting a patient support surface;

a scissors lift linkage having a top end pivotably coupled to the deck and a bottom end spaced apart from the top end, the scissors lift linkage being aligned in a linkage plane;

a frame having a surface configured to support the bottom end of the scissors lift linkage, the frame having first and second bearings for pivotably coupling the frame to the base about an axis of rotation which is parallel to the linkage plane and which is offset from said surface; and a controller for selectively moving the scissors lift linkage between an extended position and a retracted position to raise and lower, respectively, the deck relative to the base.

15. The hospital bed of claim 14, wherein the linkage plane is transverse to a longitudinal axis of the bed.

16. The hospital bed of claim 14, wherein the axis of rotation of the frame is transverse to the longitudinal axis of the bed.

17. The apparatus of claim 14, wherein the controller includes a cylinder having a piston coupled to the scissors lift linkage, the piston being movable from an extended position to a retracted position to move the scissors lift linkage between its extended position and its retracted position, respectively.

18. The apparatus of claim 17, wherein the cylinder and the piston are pivotably coupled to the scissors lift linkage.

19. The apparatus of claim 14, wherein the frame includes a top frame member and a bottom frame member, and the scissors lift linkage includes a pair of parallel scissors mechanisms coupled together by the top and bottom frame members, a first side of both of the scissors mechanisms being pivotably coupled to the top and bottom frame members and a second side of the scissors mechanisms being slidably coupled to the top and bottom frame members.

20. The apparatus of claim 19, further comprising a top pin and a bottom pin coupled to the second sides of each of the scissors mechanisms, each of the pins being movable in a corresponding track formed on the top and bottom frame members.

21. The apparatus of claim 19, wherein the controller includes a cylinder pivotably coupled to the bottom frame member of the scissors lift linkage, the cylinder having a movable piston which is pivotably coupled to a cross bar interconnecting the pair of scissors mechanisms.

22. A hospital bed comprising:

a base;

a deck having a head end and a foot end;

a first scissors lift linkage coupled between the base and the deck adjacent the head end of the deck, the first scissors lift linkage being movable from an extended position to a retracted position to raise and lower, respectively, the head end of the deck relative to the base, the first scissors lift linkage including a pair of parallel first scissors mechanisms coupled together by first top and bottom frame members, a first side of both of the first scissors mechanisms being pivotably coupled to the first top and bottom frame members and a second side of the first scissors mechanisms being slidably coupled to the first top and bottom frame members;

a second scissors lift linkage coupled between the base and the deck adjacent the foot end of the deck, the second scissors lift linkage being aligned in a plane which is generally perpendicular to a plane of the first scissors lift linkage to stabilize the deck relative to the base, the second scissors lift linkage being movable from an extended position to a retracted position to raise and lower, respectively, the foot end of the deck relative to the base, the second scissors lift linkage including a pair of parallel second scissors mechanisms coupled together by second top and bottom frame members, a first side of both of the second scissors mechanisms being pivotably coupled to the second top and bottom frame members and a second side of the second scissors mechanisms being slidably coupled to the second top and bottom frame members;

a first cylinder pivotably coupled to the first bottom frame member, the first cylinder having a first movable piston which is pivotably coupled to a cross bar interconnecting the first scissors mechanisms;

a second cylinder pivotably coupled to the second bottom frame member, the second cylinder having a second movable piston which is pivotably coupled to a cross bar interconnecting the second scissors mechanisms; and a controller for selectively and independently actuating the first and second cylinders to move the first and second scissors lift linkages between the extended positions and the retracted positions.

23. The apparatus of claim 22, wherein the first top and bottom frame members are pivotably coupled to the base and the deck, respectively.

24. The apparatus of claim 23, wherein the second bottom frame member is rigidly coupled to the base and the second top frame member is pivotably coupled to the deck.

25. The apparatus of claim 22, wherein the second bottom frame member is rigidly coupled to the base and the second top frame member is pivotably coupled to the deck.

26. The apparatus of claim 22, further comprising a top pin and a bottom pin coupled to the second sides of each of the first and second scissors mechanisms, each of the top and bottom pins being movable in a corresponding track formed on a respective one of the first and second top and bottom frame members.

27. The apparatus of claim 22, further comprising an articulable patient support surface coupled to the deck.

* * * * *